US008398306B2

(12) United States Patent
Kinigakis et al.

(10) Patent No.: US 8,398,306 B2
(45) Date of Patent: Mar. 19, 2013

(54) FLEXIBLE PACKAGE WITH INTERNAL, RESEALABLE CLOSURE FEATURE

(75) Inventors: Panagiotis Kinigakis, Roscoe, IL (US); Kenneth C. Pokusa, Indian Head Park, IL (US)

(73) Assignee: Kraft Foods Global Brands LLC, Deerfield, IL (US)

( * ) Notice: Subject to any disclaimer, the term of this patent is extended or adjusted under 35 U.S.C. 154(b) by 1484 days.

(21) Appl. No.: 11/267,174

(22) Filed: Nov. 7, 2005

(65) Prior Publication Data

US 2007/0104395 A1 May 10, 2007

(51) Int. Cl.
*B65D 33/00* (2006.01)
*B65D 65/26* (2006.01)
*B65D 33/14* (2006.01)

(52) U.S. Cl. ..... 383/211; 383/210; 383/5; 383/203

(58) Field of Classification Search ..... 383/61.1, 383/95, 210, 211, 203, 204, 207, 209, 5
See application file for complete search history.

(56) References Cited

U.S. PATENT DOCUMENTS

| | | | | |
|---|---|---|---|---|
| 2,778,171 | A * | 1/1957 | Taunton | 53/405 |
| 2,954,901 | A | 10/1960 | Winstead | |
| 2,991,001 | A | 7/1961 | Hughes | |
| 3,217,871 | A | 5/1963 | Lee | |
| 3,154,239 | A | 10/1964 | Madsen | |
| 3,608,707 | A | 9/1971 | Miller | |
| 3,616,898 | A | 11/1971 | Massie | |
| 3,653,502 | A | 4/1972 | Beaudoin | |
| 3,879,492 | A | 4/1975 | Bontinick | |
| 3,885,977 | A | 5/1975 | Lachman et al. | |
| 4,058,645 | A | 11/1977 | Steiner | |
| 4,061,820 | A | 12/1977 | Magid et al. | |
| 4,082,877 | A | 4/1978 | Shadle | |
| 4,337,862 | A | 7/1982 | Suter | |
| 4,361,237 | A | 11/1982 | Heiremans et al. | |
| 4,367,312 | A | 1/1983 | Bontinck et al. | |
| 4,399,249 | A | 8/1983 | Bildusas | |
| 4,488,647 | A | 12/1984 | Davis | |

(Continued)

FOREIGN PATENT DOCUMENTS

| | | |
|---|---|---|
| DE | 4410235 | 9/1995 |
| DE | 20113173 U1 | 10/2001 |

(Continued)

OTHER PUBLICATIONS

U.S. Appl. No. 29/242,117, filed Nov. 7, 2005, (K. Pokusa, P. Kinigakis).

(Continued)

*Primary Examiner* — Justin Larson
*Assistant Examiner* — Peter Helvey
(74) *Attorney, Agent, or Firm* — Fitch, Even, Tabin & Flannery LLP

(57) ABSTRACT

A reclosable flexible package having a reclosable closure comprising easy-to-use adhesive securement means in combination with non-reclosable closures provided above and below the reclosable closure. The package provides a re-openable seal for reclosing the bag upon a partial discharge of the contents thereof, such as food contents. The flexible package offers manufacturing ease and cost-savings, and tamper-resistance. The flexible package also may be incorporated into a bag-in-box package configuration. Methods of making and filling the package also are provided.

19 Claims, 7 Drawing Sheets

U.S. PATENT DOCUMENTS

| | | | | |
|---|---|---|---|---|
| 4,506,488 | A | 3/1985 | Matt et al. | |
| 4,512,479 | A | 4/1985 | Hain et al. | |
| 4,533,445 | A | 8/1985 | Orio | |
| 4,533,509 | A | 8/1985 | Gust et al. | |
| 4,556,595 | A | 12/1985 | Ochi | |
| 4,572,377 | A | 2/1986 | Beckett | |
| 4,576,854 | A | 3/1986 | Kurahashi | |
| 4,623,398 | A | 11/1986 | Goodman et al. | |
| 4,661,099 | A | 4/1987 | von Bittera et al. | |
| 4,674,634 | A * | 6/1987 | Wilson | 206/554 |
| 4,676,394 | A * | 6/1987 | Hiersteiner | 229/117.34 |
| 4,696,849 | A | 9/1987 | Mobley et al. | |
| 4,705,174 | A | 11/1987 | Goglio | |
| 4,709,396 | A | 11/1987 | Voshall et al. | |
| 4,709,397 | A | 11/1987 | Voshall et al. | |
| 4,728,572 | A | 3/1988 | Davis | |
| 4,745,138 | A | 5/1988 | Thanawalla et al. | |
| 4,752,342 | A | 6/1988 | Tatum et al. | |
| 4,759,642 | A * | 7/1988 | Van Erden et al. | 383/210 |
| 4,771,935 | A | 9/1988 | Hekal | |
| 4,785,940 | A | 11/1988 | Wilson | |
| 4,786,190 | A | 11/1988 | Van Erden et al. | |
| 4,791,024 | A | 12/1988 | Clerici et al. | |
| 4,810,523 | A | 3/1989 | Williams et al. | |
| 4,810,541 | A | 3/1989 | Newman et al. | |
| 4,810,745 | A | 3/1989 | Pike et al. | |
| 4,855,077 | A | 8/1989 | Shikinami et al. | |
| 4,859,521 | A | 8/1989 | Pike et al. | |
| 4,889,884 | A | 12/1989 | Dust et al. | |
| 4,898,280 | A | 2/1990 | Runge | |
| 4,898,787 | A | 2/1990 | Min et al. | |
| 4,901,515 | A | 2/1990 | McLeod et al. | |
| 4,902,142 | A | 2/1990 | Lammert et al. | |
| 4,902,578 | A | 2/1990 | Kerr, III | |
| 4,931,327 | A | 6/1990 | Liu et al. | |
| 4,946,728 | A | 8/1990 | Ikeda et al. | |
| 4,970,113 | A | 11/1990 | Yamada | |
| 4,982,064 | A | 1/1991 | Hartman et al. | |
| 5,062,569 | A | 11/1991 | Hekal | |
| 5,064,717 | A | 11/1991 | Suzuki et al. | |
| 5,073,457 | A | 12/1991 | Blackwell | |
| 5,089,320 | A | 2/1992 | Straus et al. | |
| 5,134,001 | A | 7/1992 | Osgood | |
| 5,141,789 | A | 8/1992 | Matsuzawa et al. | |
| 5,145,737 | A | 9/1992 | Boiron et al. | |
| 5,151,318 | A | 9/1992 | Strasilla et al. | |
| 5,173,344 | A | 12/1992 | Hughes | |
| 5,174,659 | A | 12/1992 | Laske | |
| 5,200,268 | A | 4/1993 | Hamada | |
| 5,234,730 | A | 8/1993 | Lautenschlaeger et al. | |
| 5,248,715 | A | 9/1993 | Gray et al. | |
| 5,286,781 | A | 2/1994 | Gotoh et al. | |
| 5,290,842 | A | 3/1994 | Sasaki et al. | |
| 5,308,666 | A * | 5/1994 | Borchardt | 428/35.2 |
| 5,334,643 | A | 8/1994 | Gage | |
| 5,352,466 | A | 10/1994 | Delonis | |
| 5,382,472 | A | 1/1995 | Yanidis et al. | |
| 5,384,341 | A | 1/1995 | Itagaki et al. | |
| 5,392,986 | A | 2/1995 | Beer et al. | |
| 5,405,896 | A | 4/1995 | Fujiki et al. | |
| 5,409,115 | A | 4/1995 | Barkhorn | |
| 5,413,829 | A | 5/1995 | Brown et al. | |
| 5,437,911 | A | 8/1995 | Rohrka et al. | |
| 5,449,552 | A | 9/1995 | Bochow et al. | |
| 5,454,207 | A | 10/1995 | Storandt | |
| 5,460,844 | A | 10/1995 | Gaylor | |
| 5,473,016 | A | 12/1995 | Fujii et al. | |
| 5,519,982 | A | 5/1996 | Herber et al. | |
| 5,527,576 | A | 6/1996 | Maul et al. | |
| 5,538,771 | A | 7/1996 | Nakayama et al. | |
| 5,575,747 | A | 11/1996 | Dais et al. | |
| 5,616,400 | A | 4/1997 | Zhang | |
| 5,619,058 | A | 4/1997 | Kim | |
| 5,626,929 | A | 5/1997 | Stevenson | |
| 5,634,969 | A | 6/1997 | Cody et al. | |
| 5,639,811 | A | 6/1997 | Plamthottam et al. | |
| 5,662,983 | A | 9/1997 | Stark | |
| 5,691,052 | A | 11/1997 | Jones | |
| 5,706,961 | A * | 1/1998 | Morano | 215/11.3 |
| 5,716,698 | A | 2/1998 | Schreck et al. | |
| 5,725,312 | A | 3/1998 | May | |
| 5,733,652 | A | 3/1998 | Stowman et al. | |
| 5,739,087 | A | 4/1998 | Dennis | |
| 5,747,560 | A | 5/1998 | Christiani et al. | |
| 5,773,136 | A | 6/1998 | Alder et al. | |
| 5,780,376 | A | 7/1998 | Gonzales et al. | |
| 5,792,549 | A | 8/1998 | Wilkie | |
| 5,792,812 | A | 8/1998 | Fujiki et al. | |
| 5,795,834 | A | 8/1998 | Deeb et al. | |
| 5,807,637 | A | 9/1998 | Schumann et al. | |
| 5,814,382 | A | 9/1998 | Yannuzzi, Jr. | |
| 5,830,547 | A | 11/1998 | MacKenzie et al. | |
| 5,863,977 | A | 1/1999 | Fischer et al. | |
| 5,882,749 | A | 3/1999 | Jones et al. | |
| 5,882,789 | A | 3/1999 | Jones et al. | |
| 5,885,673 | A | 3/1999 | Light et al. | |
| 5,912,084 | A | 6/1999 | Hausmann et al. | |
| 5,924,795 | A * | 7/1999 | Thompson et al. | 383/204 |
| 5,952,420 | A | 9/1999 | Senkus et al. | |
| 5,958,531 | A | 9/1999 | Stevenson | |
| 5,972,448 | A | 10/1999 | Frisk et al. | |
| 5,981,650 | A | 11/1999 | Zhao et al. | |
| 5,993,962 | A | 11/1999 | Timm et al. | |
| 5,997,968 | A | 12/1999 | Dries et al. | |
| 6,006,913 | A | 12/1999 | Ludemann et al. | |
| 6,012,844 | A | 1/2000 | Huseman et al. | |
| 6,015,934 | A | 1/2000 | Lee et al. | |
| 6,017,623 | A | 1/2000 | Nakanishi | |
| 6,022,612 | A | 2/2000 | Wilkie | |
| 6,034,163 | A | 3/2000 | Barbee et al. | |
| 6,036,765 | A | 3/2000 | Farrow et al. | |
| D423,346 | S | 4/2000 | Froehlich et al. | |
| 6,084,010 | A | 7/2000 | Baetzold et al. | |
| 6,096,387 | A | 8/2000 | Decker | |
| 6,099,682 | A | 8/2000 | Krampe et al. | |
| 6,117,531 | A | 9/2000 | Schacht et al. | |
| 6,129,983 | A | 10/2000 | Schumann et al. | |
| 6,172,156 | B1 | 1/2001 | Lindquist et al. | |
| 6,184,264 | B1 | 2/2001 | Webster | |
| 6,196,716 | B1 | 3/2001 | Geyer | |
| 6,199,698 | B1 | 3/2001 | Hetrick et al. | |
| 6,200,677 | B1 | 3/2001 | Richardson et al. | |
| 6,210,796 | B1 | 4/2001 | Lobert et al. | |
| 6,238,090 | B1 | 5/2001 | Yuter | |
| 6,244,748 | B1 | 6/2001 | Kasai et al. | |
| 6,279,297 | B1 | 8/2001 | Latronico | |
| 6,287,658 | B1 | 9/2001 | Cosentino et al. | |
| 6,312,828 | B1 | 11/2001 | Akao | |
| 6,318,894 | B1 | 11/2001 | Derenthal | |
| 6,331,336 | B1 | 12/2001 | Szonn et al. | |
| 6,351,857 | B2 * | 3/2002 | Slaon et al. | 4/315 |
| 6,355,732 | B1 | 3/2002 | Beer | |
| 6,358,576 | B1 | 3/2002 | Adur et al. | |
| 6,358,622 | B1 | 3/2002 | Shida et al. | |
| 6,359,052 | B1 | 3/2002 | Trexler, Jr. et al. | |
| 6,371,644 | B1 | 4/2002 | Forman | |
| 6,376,591 | B1 | 4/2002 | Lan et al. | |
| 6,384,121 | B1 | 5/2002 | Barbee et al. | |
| 6,388,006 | B1 | 5/2002 | Fujita et al. | |
| 6,389,651 | B2 * | 5/2002 | Johnson | 24/30.5 R |
| 6,398,412 | B2 * | 6/2002 | Wedi et al. | 383/211 |
| 6,417,262 | B1 | 7/2002 | Turner et al. | |
| 6,423,768 | B1 | 7/2002 | Khouri | |
| 6,429,235 | B1 | 8/2002 | Varlemann et al. | |
| 6,444,742 | B1 | 9/2002 | Rong et al. | |
| 6,451,398 | B1 | 9/2002 | Sylvester | |
| 6,451,426 | B2 | 9/2002 | Kong et al. | |
| 6,461,044 | B1 | 10/2002 | Anderson | |
| 6,461,708 | B1 | 10/2002 | Dronzek | |
| 6,465,543 | B1 | 10/2002 | Alexandre et al. | |
| 6,467,957 | B2 * | 10/2002 | Yeager | 383/211 |
| 6,485,826 | B1 | 11/2002 | Watanabe et al. | |
| 6,486,253 | B1 | 11/2002 | Gilmer et al. | |
| 6,499,878 | B1 | 12/2002 | Dobreski et al. | |
| D470,757 | S | 2/2003 | Espinel et al. | |
| 6,521,678 | B1 | 2/2003 | Chaiko | |
| 6,521,690 | B1 | 2/2003 | Ross et al. | |

6,524,700 B2 2/2003 Masuda et al.
6,541,098 B2 4/2003 Venkatasanthanam et al.
6,548,587 B1 4/2003 Bagrodia et al.
6,552,114 B2 4/2003 Turner et al.
6,599,622 B1 7/2003 Chu et al.
6,608,134 B1 8/2003 Tobing et al.
6,613,831 B1 9/2003 Bentley et al.
6,624,273 B1 9/2003 Everaerts et al.
6,630,220 B1 10/2003 Veiga
6,632,522 B1 10/2003 Hyde et al.
6,709,759 B2 3/2004 Mueller et al.
6,713,152 B2 3/2004 Chen et al.
6,713,547 B2 3/2004 Barbee et al.
6,723,403 B2 4/2004 Ishii et al.
6,723,407 B2 4/2004 Dollase et al.
6,743,451 B2 * 6/2004 Rasile et al. ..... 383/203
6,767,951 B2 7/2004 Nair et al.
6,770,697 B2 8/2004 Drewniak et al.
6,777,490 B2 8/2004 Mussig et al.
6,787,592 B1 9/2004 Powell et al.
6,815,025 B2 11/2004 Kawamura et al.
6,831,123 B1 12/2004 Chisholm et al.
6,838,508 B2 1/2005 Hsiao et al.
6,841,241 B2 1/2005 Luhmann et al.
6,844,079 B2 1/2005 Holzer et al.
6,849,313 B2 2/2005 Mechelaere et al.
6,852,422 B2 2/2005 Kendall et al.
6,863,646 B2 3/2005 Kinigakis et al.
6,884,207 B2 4/2005 Pokusa
6,896,956 B2 5/2005 Kong
6,913,809 B2 7/2005 Wolak
6,979,379 B2 12/2005 White, II
6,991,375 B2 * 1/2006 Clune et al. ..... 383/203
7,135,508 B2 11/2006 Chaiko et al.
7,141,293 B2 11/2006 Peiffer et al.
7,157,516 B2 1/2007 Chaiko
7,163,720 B1 1/2007 Dhaler et al.
7,165,888 B2 * 1/2007 Rodick ..... 383/211
7,166,656 B2 1/2007 Majumdar et al.
7,186,452 B2 3/2007 Peiffer et al.
7,189,781 B2 3/2007 Acevedo et al.
7,205,040 B2 4/2007 Peiffer et al.
D541,667 S 5/2007 Pokusa et al.
D541,668 S 5/2007 Pokusa et al.
D541,669 S 5/2007 Pokusa et al.
7,211,306 B2 5/2007 Peiffer et
7,244,223 B2 * 7/2007 Hartman et al. ..... 493/213
7,267,858 B2 9/2007 Ono et al.
7,268,173 B2 9/2007 Graichen et al.
7,329,439 B2 2/2008 Sachdev et al.
7,329,453 B2 2/2008 Peiffer et al.
7,354,635 B2 4/2008 Malfait et al.
7,368,165 B2 5/2008 Sankey et al.
7,368,496 B2 5/2008 Kim et al.
7,371,793 B2 5/2008 Gong et al.
7,393,581 B2 7/2008 Kim et al.
7,396,578 B2 7/2008 Peiffer et al.
7,399,263 B2 * 7/2008 Hartman et al. ..... 493/213
7,413,800 B2 8/2008 Wood, Jr. et al.
7,491,434 B2 * 2/2009 Khandpur et al. ..... 428/36.5
7,495,051 B2 2/2009 Nelson et al.
7,740,923 B2 6/2010 Exner et al.
7,892,391 B2 2/2011 Kendig et al.
2001/0012557 A1 8/2001 Willham et al.
2001/0019765 A1 9/2001 Kiuchi et al.
2001/0021451 A1 9/2001 Tokunaga et al.
2001/0035593 A1 11/2001 Peiffer et al.
2001/0039302 A1 11/2001 Wustling et al.
2001/0049414 A1 12/2001 Muller et al.
2001/0055679 A1 12/2001 Schumann et al.
2002/0009563 A1 1/2002 Kawamura et al.
2002/0028335 A1 3/2002 Fujiki et al.
2002/0098347 A1 7/2002 Szonn et al.
2002/0114948 A1 8/2002 Schumann et al.
2002/0122977 A1 9/2002 Fujimatsu et al.
2002/0137834 A1 9/2002 Barbee et al.
2002/0160037 A1 10/2002 Ahrens et al.
2002/0165306 A1 11/2002 Gilmer et al.
2002/0193494 A1 12/2002 Gilmer et al.
2003/0012936 A1 * 1/2003 Draheim et al. ..... 428/216
2003/0013796 A1 1/2003 Turner et al.
2003/0039412 A1 * 2/2003 Rodick ..... 383/211
2003/0072957 A1 4/2003 Lee et al.
2003/0082370 A1 5/2003 Husemann et al.
2003/0082371 A1 * 5/2003 Mazurek et al. ..... 428/343
2003/0091763 A1 5/2003 Ferri
2003/0096108 A1 5/2003 Mussig et al.
2003/0100656 A1 5/2003 Majumdar et al.
2003/0103690 A1 * 6/2003 Schneider et al. ..... 383/211
2003/0118759 A1 6/2003 Yoshikawa et al.
2003/0138624 A1 7/2003 Burmeister et al.
2003/0144398 A1 7/2003 Cody et al.
2003/0152735 A1 8/2003 Koike
2003/0159601 A1 * 8/2003 Wynne ..... 101/128.21
2003/0170357 A1 9/2003 Garwood
2003/0180530 A1 9/2003 Otten et al.
2003/0209453 A1 11/2003 Herman
2003/0211308 A1 * 11/2003 Khandpur et al. ..... 428/317.3
2003/0219585 A1 11/2003 Yamanaka et al.
2003/0219612 A1 11/2003 Massey
2003/0223656 A1 * 12/2003 Razeti et al. ..... 383/66
2003/0235664 A1 12/2003 Merical et al.
2004/0007319 A1 1/2004 Squier et al.
2004/0031798 A1 2/2004 Fox et al.
2004/0038040 A1 2/2004 Schumann et al.
2004/0052993 A1 3/2004 Dawes
2004/0063841 A1 4/2004 Gilmer et al.
2004/0067284 A1 4/2004 Sankey et al.
2004/0067294 A1 4/2004 Pedrick et al.
2004/0081780 A1 4/2004 Goldman
2004/0097630 A1 5/2004 Whitman et al.
2004/0106693 A1 6/2004 Kauffman et al.
2004/0132906 A1 7/2004 Guerin et al.
2004/0142193 A1 7/2004 Husemann et al.
2004/0161178 A1 8/2004 Olechowski
2004/0180197 A1 9/2004 Everaerts et al.
2004/0191438 A1 9/2004 Cosentino et al.
2004/0219336 A1 11/2004 Sano
2004/0234175 A1 11/2004 Takita et al.
2005/0019382 A1 1/2005 Kummer et al.
2005/0031233 A1 2/2005 Varanese et al.
2005/0041888 A1 * 2/2005 Matsuzawa et al. ..... 383/204
2005/0042468 A1 2/2005 Peiffer et al.
2005/0063619 A1 3/2005 Kinigakis et al.
2005/0074619 A1 4/2005 Peiffer et al.
2005/0121822 A1 6/2005 Peiffer et al.
2005/0137310 A1 6/2005 Gupta et al.
2005/0170086 A1 8/2005 Tynan et al.
2005/0182186 A1 8/2005 Gielens et al.
2005/0208282 A1 9/2005 Wood, Jr. et al.
2005/0209356 A1 9/2005 Erickson
2005/0217558 A1 10/2005 Fitzer et al.
2005/0249903 A1 11/2005 Kendig et al.
2005/0249906 A1 11/2005 Sankey et al.
2005/0266257 A1 12/2005 Lee et al.
2005/0276940 A1 12/2005 Stevenson
2005/0282948 A1 12/2005 Li et al.
2006/0029300 A1 2/2006 Yoder
2006/0046595 A1 3/2006 Imaizumi et al.
2006/0062955 A1 3/2006 Liu et al.
2006/0074167 A1 4/2006 Nelson et al.
2006/0094810 A1 5/2006 Kim et al.
2006/0094811 A1 5/2006 Kim et al.
2006/0111499 A1 5/2006 Kim et al.
2006/0121224 A1 6/2006 Kim et al.
2006/0122311 A1 6/2006 Kim et al.
2006/0122312 A1 6/2006 Kim et al.
2006/0128867 A1 6/2006 Marx et al.
2006/0141183 A1 6/2006 Williamson et al.
2006/0141241 A1 6/2006 Carespodi et al.
2006/0172098 A1 8/2006 Stevenson
2006/0173124 A1 8/2006 Paul et al.
2006/0199890 A1 9/2006 Fasulo et al.
2006/0205916 A1 9/2006 Takekoshi et al.
2006/0211804 A1 9/2006 Kim et al.
2006/0222797 A1 10/2006 Bekele
2006/0228057 A1 10/2006 Newrones et al.
2006/0234047 A1 10/2006 Wenninger et al.

| | | | |
|---|---|---|---|
| 2006/0240204 | A1 | 10/2006 | Ling et al. |
| 2006/0240209 | A1 | 10/2006 | Sano |
| 2006/0257640 | A1 | 11/2006 | Schumann et al. |
| 2006/0269707 | A1 | 11/2006 | Berbert |
| 2007/0078212 | A1 | 4/2007 | Kim et al. |
| 2007/0104395 | A1 | 5/2007 | Kinigakis et al. |
| 2007/0116914 | A1 | 5/2007 | Koike |
| 2007/0135563 | A1 | 6/2007 | Simmons et al. |
| 2007/0158023 | A1 | 7/2007 | Miyake et al. |
| 2007/0179254 | A1 | 8/2007 | Wang et al. |
| 2007/0196610 | A1 | 8/2007 | O'Rourke et al. |
| 2007/0199481 | A1 | 8/2007 | Roelofs |
| 2007/0213464 | A1 | 9/2007 | Zollner et al. |
| 2007/0267737 | A1 | 11/2007 | Chen et al. |
| 2007/0282064 | A1 | 12/2007 | Dollase et al. |
| 2008/0081186 | A1 | 4/2008 | Ellringmann et al. |
| 2008/0118688 | A1 | 5/2008 | Kinigakis et al. |
| 2008/0131636 | A1 | 6/2008 | Kinigakis et al. |
| 2008/0151031 | A1 | 6/2008 | Kobayashi |
| 2008/0152850 | A1 | 6/2008 | Paterson |
| 2008/0159666 | A1 | 7/2008 | Exner et al. |
| 2008/0160293 | A1 | 7/2008 | Arimitsu et al. |
| 2008/0170814 | A1 | 7/2008 | Bowers et al. |
| 2008/0176980 | A1 | 7/2008 | Torkelson et al. |
| 2008/0206417 | A1 | 8/2008 | Kirsch et al. |
| 2008/0223007 | A1 | 9/2008 | Friebe et al. |
| 2008/0255296 | A1 | 10/2008 | Gibbons et al. |
| 2008/0262126 | A1 | 10/2008 | Fleischer et al. |
| 2008/0281038 | A1 | 11/2008 | Takahashi et al. |
| 2009/0036580 | A1 | 2/2009 | Qian et al. |
| 2009/0043024 | A1 | 2/2009 | Brunelle et al. |
| 2009/0048398 | A1 | 2/2009 | Zollner et al. |
| 2009/0053388 | A1 | 2/2009 | Powers et al. |
| 2009/0053445 | A1 | 2/2009 | Trent et al. |
| 2009/0061137 | A1 | 3/2009 | Konrad et al. |
| 2009/0061138 | A1 | 3/2009 | Peiffer et al. |
| 2009/0098327 | A1 | 4/2009 | Buchbinder et al. |
| 2009/0098375 | A1 | 4/2009 | Voisin et al. |
| 2009/0186220 | A1 | 7/2009 | Palasz |
| 2010/0092793 | A1 | 4/2010 | Aithani et al. |
| 2010/0178394 | A1 | 7/2010 | Exner et al. |
| 2010/0239721 | A1 | 9/2010 | Stoppello et al. |
| 2011/0068040 | A1 | 3/2011 | Kendig et al. |
| 2011/0143133 | A1 | 6/2011 | Kinigakis et al. |

FOREIGN PATENT DOCUMENTS

| | | | |
|---|---|---|---|
| DE | 102005013585 | A1 | 9/2006 |
| EP | 0290147 | | 9/1988 |
| EP | 0338304 | A2 | 10/1989 |
| EP | 0439941 | | 8/1991 |
| EP | 0516276 | | 2/1992 |
| EP | 0539099 | | 4/1993 |
| EP | 0684970 | | 12/1995 |
| EP | 0772553 | | 5/1997 |
| EP | 0802044 | | 10/1997 |
| EP | 0848726 | | 6/1998 |
| EP | 1010632 | A1 | 6/2000 |
| EP | 1010638 | A1 | 6/2000 |
| EP | 1080881 | | 3/2001 |
| EP | 1144494 | | 10/2001 |
| EP | 1 164 087 | A2 | 12/2001 |
| EP | 1177245 | | 2/2002 |
| EP | 1232960 | | 8/2002 |
| EP | 1232960 | A2 | 8/2002 |
| EP | 1281623 | | 2/2003 |
| EP | 1288139 | A1 | 3/2003 |
| EP | 1344642 | | 9/2003 |
| EP | 1356925 | | 10/2003 |
| EP | 1460117 | A1 | 9/2004 |
| EP | 1475229 | | 11/2004 |
| EP | 1496085 | | 1/2005 |
| EP | 1529799 | | 5/2005 |
| EP | 1541480 | A1 | 6/2005 |
| EP | 1591236 | | 11/2005 |
| EP | 1642914 | | 5/2006 |
| EP | 1010638 | | 6/2006 |
| EP | 1676785 | A1 | 7/2006 |
| EP | 1714895 | A1 | 10/2006 |
| EP | 1733640 | | 12/2006 |
| EP | 1739024 | | 1/2007 |
| EP | 1785447 | | 5/2007 |
| EP | 1905584 | | 2/2008 |
| EP | 2090600 | | 8/2009 |
| EP | 2319765 | | 5/2011 |
| FR | 2150897 | | 5/1973 |
| FR | 2769867 | | 4/1999 |
| FR | 2783512 | | 3/2000 |
| GB | 1423548 | | 2/1976 |
| GB | 2339187 | A | 1/2000 |
| JP | 59018774 | | 1/1984 |
| JP | 5-221454 | A | 8/1993 |
| JP | 6072078 | | 3/1994 |
| JP | 10146931 | | 6/1998 |
| JP | 11035907 | | 2/1999 |
| JP | 00198170 | | 7/2000 |
| JP | 2003-95285 | A | 4/2003 |
| JP | 2005041544 | | 2/2005 |
| JP | 2005280736 | | 10/2005 |
| JP | 2006315385 | A | 11/2006 |
| RU | 2237689 | | 10/2004 |
| RU | 2244668 | | 1/2005 |
| WO | 9516743 | | 6/1995 |
| WO | 9748554 | | 12/1997 |
| WO | 9800471 | | 1/1998 |
| WO | 9952972 | | 10/1999 |
| WO | 0039200 | | 7/2000 |
| WO | 00/58167 | A1 | 10/2000 |
| WO | 0187566 | | 11/2001 |
| WO | 0222729 | | 3/2002 |
| WO | 0226579 | A1 | 4/2002 |
| WO | 03011961 | | 2/2003 |
| WO | 03035391 | | 5/2003 |
| WO | 03040199 | | 5/2003 |
| WO | 03091020 | | 11/2003 |
| WO | 2004080808 | | 9/2004 |
| WO | 2005005276 | | 1/2005 |
| WO | 2005014406 | A2 | 2/2005 |
| WO | 2005040268 | | 5/2005 |
| WO | 2005056644 | | 6/2005 |
| WO | 2005116132 | | 12/2005 |
| WO | 2006009360 | | 1/2006 |
| WO | 2006045896 | | 5/2006 |
| WO | 2006058952 | | 6/2006 |
| WO | 2006071833 | | 7/2006 |
| WO | 2006100084 | A1 | 9/2006 |
| WO | 2006111177 | A1 | 10/2006 |
| WO | 2007009200 | | 1/2007 |
| WO | 2007012805 | | 2/2007 |
| WO | 2007019142 | | 2/2007 |
| WO | 2007027423 | | 3/2007 |
| WO | 2007090265 | | 8/2007 |
| WO | 2007093798 | | 8/2007 |
| WO | 2007106671 | | 9/2007 |
| WO | 2007115310 | | 10/2007 |
| WO | 2007121048 | | 10/2007 |
| WO | 2007121049 | | 10/2007 |
| WO | 2007123582 | | 11/2007 |
| WO | 2007130755 | | 11/2007 |
| WO | 2007146390 | | 12/2007 |
| WO | 2008043750 | | 4/2008 |
| WO | 2008053205 | | 5/2008 |
| WO | 2008115693 | | 9/2008 |
| WO | 2008127485 | | 10/2008 |
| WO | 2010088492 | | 8/2010 |
| ZW | 2894 | | 5/1994 |

OTHER PUBLICATIONS

U.S. Appl. No. 29/242,118, filed Nov. 7, 2005, (K. Pokusa, P. Kinigakis).

U.S. Appl. No. 29/242,119, filed Nov. 7, 2005, (K. Pokusa, P. Kinigakis).

*Patent Abstracts of Japan,* Publication No. 05-221454, Aug. 31, 1993.

*Patent Abstracts of Japan,* Publication No. 2003-095285, Apr. 3, 2003.

European Patent Office Extended European Search Report dated Mar. 5, 2007 for European Application No. 06122144.6, 8 pages.

Kuusipalo, J.; Re-sealing studies of cold seal latexes for paper based packages; Finnish Paper and Wood Journal Ltd., 2000, vol. 82, No. 3, pp. 189-192.
Bentley, D.; About Cold Seal Adhesives, Paper, Film and Foil Converter, Jan. 1, 2006, Internet Printout; 4 pgs.
Dow Introduces HYPOD Polyolefin Dispersions, Midland, Michigan, Jul. 11, 2007, [online]. Retrieved from the Internet: http://news.dow.com/prodbus/20070711b.htm; 2 pgs.
European Patent Office European Search Report and Written Opinion, dated Jan. 14, 2008; EP Application No. 07115566.7; 9 pgs.
European Patent Office Extended European Search Report and Written Opinion, dated Apr. 4, 2011; EP Application No. 11156091.8; 4 pgs.
European Patent Office Extended European Search Report and Written Opinion, dated Apr. 4, 2011; EP Application No. 11156092.6; 5 pgs.
European Patent Office Extended European Search Report and Written Opinion, dated Apr. 4, 2011; EP Application No. 11156093.4; 5 pgs.
European Patent Office, Notification of Transmittal of the International Search Report and the Written Opinion of the International Searching Authority for International Application No. PCT/US2009/042998 dated Aug. 6, 2009; 12 pgs.
Notice of Opposition filed by Opponent BASF in the European Patent Office; EP Patent No. 1939106; dated Dec. 8, 2009; 6 pgs.
Notice of Opposition filed by Opponent Cadbury in the European Patent Office; EP Patent No. 1939106; dated Dec. 3, 2009; 5 pgs.
Notice of Opposition filed by Opponent Ritter in the European Patent Office; EP Patent No. 1939106; dated Nov. 26, 2009; 14 pgs.
PCT International Search Report, dated Mar. 25, 2009; PCT/US2009/33677; 3 pgs.
Response to Notice of Opposition, dated Jul. 21, 2010; EP Patent No. 1939106; 12 pgs.
The International Bureau of WIPO, Notification Concerning Transmittal of International Preliminary Report on Patentability (Chapter 1 of the Patent Cooperation Treaty) for International Application No. PCT/US2009/042998 dated Nov. 18, 2010; 7 pgs.
European Search Report issued on Oct. 17, 2012 in European Patent Application EP06122144.6.
European Search Report issued on Oct. 18, 2012 in European Patent Application EP10184331.6.
European Search Report issued on Oct. 18, 2012 in European Patent Application EP10184281.3.

* cited by examiner

FLEXIBLE PACKAGE WITH INTERNAL, RESEALABLE CLOSURE FEATURE

FIELD OF THE INVENTION

This invention relates to flexible packages, such as plastic bags, and in particular to package closures employing adhesives.

Certain packages for food products comprised of particulates, such as shredded cheese, cereal, trail mix, nuts, dried fruit, small cookies, crackers, chocolate, confections, for example, comprise a pouch which is open at one end, or along one side, so as to allow product to be poured or shaken through a reclosable opening.

One widely used means of providing package reclosability is to employ zippers compatible with flexible packages of plastic film construction. One problem with such zippers is that application of zippers to a film roll makes the film roll bulky and more difficult to handle. Although packaging zippers can be applied in high speed in line form-fill-seal operations, the equipment requirements for application of zippers and the expense of the zipper materials can be significant. In addition, zippers may not provide hermetic seals when desired. Also, some consumers have difficulty operating and manipulating zipper closures.

Improvements are desired in packaging closures which are simple and economical yet reliable, durable, and tamper-resistant.

SUMMARY

The invention provides a reclosable flexible package having a reclosable closure comprising easy-to-use adhesive securement means in combination with non-reclosable closures provided above and below the reclosable closure.

In one embodiment, a reclosable flexible package has opposed front and rear panels joined together to define a cavity enclosed by opposite side portions and a bottom portion of the package. An openable or removable non-reclosable closure, located at an upper end portion opposite the bottom portion and extending between opposite side portions of the package, is adapted to define a package mouth when opened or removed. An openable reclosable closure extending between the opposite side portions of the package at a location below the sealed portion, is adapted to be manually pulled open and reclosed for selectively opening and closing the mouth after the sealed portion has been opened. Another openable non-reclosable closure extends between the opposite side portions of the package at a location below the reclosable closure.

In one particular embodiment, the reclosable closure comprises a reclosable coating provided on at least one of the interior faces of the front and rear panels of the package. Whether applied to one or both interior faces of the front and rear panels, the reclosable coating is adapted to releasably attach the interior faces of front and rear panels of the package. The "reclosable coating" refers to a thin layer of material applied onto the film substrate that is solid at room temperature, has a surface energy substantially similar to the sealant side of the film substrate, and produces mutually bondable surfaces. In one embodiment, the reclosable closure comprises substantially continuous bands of reclosable coating oppositely aligned on interior opposing faces of the front and rear panels, wherein the bands are adapted to be manually pressed into mutual adhering contact and manually pulled apart more than once. In one embodiment, the reclosable coating has balanced tack such that it has sufficient tack to allow multiple unsealings and resealings of the package walls at the closure site, but also it is not overly tacky so that it has low-pick up of food contents of the package sufficient to reduce incidence and rate of contamination-deadening of the reclosable closure from food dispensing. In one embodiment, the reclosable coating is selected from the group consisting of ethylene vinyl acetate copolymers, water-based acrylics, curable acrylics, and styrenic block copolymers. The reclosable coating material may be a transparent, translucent or a tinted coating material.

In another particular embodiment, the reclosable closure comprises a self-supporting tape material attached on interior faces of the front and rear panels of the package. The self-supporting tape material may comprise a laminate construction comprising a single-faced adhesive tape substrate, which bears a reclosable coating on the non-tacky side thereof. The tape may be a transparent, translucent or tinted discrete band material.

Food product may be introduced into the package cavity before the closures are sealed, providing a resealable food package. The package may further include visual textual and/or tactile indicia providing user instructions or guidance for applying pressure at the reclosable closure for reclosing the package. The package optionally may further include a rupturable line of weakness between the openable or removable non-reclosable closure at the upper end of the package and the reclosable closure, which is adapted, upon complete rupture, to remove the upper non-reclosable closure and provide a package opening. To facilitate rupture and opening the package mouth, the line of weakness optionally may intersect a notch provided on at least one side edge of the package. The package construction may comprise a folded polymeric sheet providing front and rear wall panels which are joined at opposite side portions thereof and folded at a bottom portion thereof. In another folded configuration, the package is folded at the opposite side portions sufficient to provide flaps extending in a machine direction which are arranged to include an overlap portion which is sealed, or a fin seal, and a bottom portion is sealed in a cross-machine direction. In another embodiment, the flexible package also may be incorporated into a bag-in-box package configuration.

The resealable flexible packages may provide greater manufacturing efficiencies and cost savings as compared to known packages with integral zippers. Also, tamper resistance is provided for the reclosable closure and package contents by provision of manually-openable, non-reclosable hermetic seals at both sides of the reclosable closure. The hermetic seals also better isolate the reclosable closure during manufacture, shipping, storage, handling and display, etc., until purchased and used by a consumer. Methods of forming and filling the reclosable package also are provided. The packages can be used to store a wide variety of foods. They can be used to store snacks, such as trail mix, nuts, dried fruit, small cookies, crackers, chocolate, confections, etc. They also can be used to store, e.g., cheese, meat, cereal, ground coffee beans, etc.

The figures are not necessarily drawn to scale. Similarly numbered elements in different figures represent like features unless indicated otherwise.

DETAILED DESCRIPTION OF THE PREFERRED EMBODIMENTS

Figure 1:
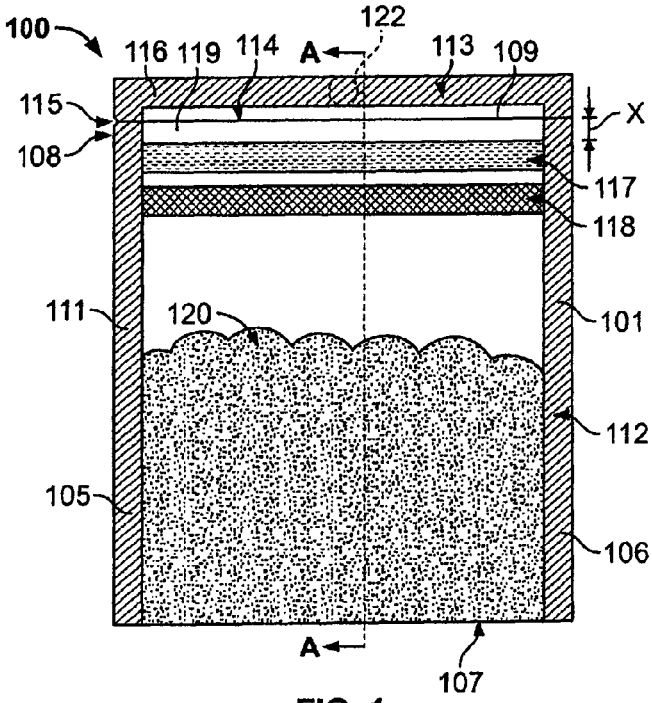
FIG. 1 is a front elevational view of a flexible reclosable package according to an embodiment of the invention.
Figure 2:
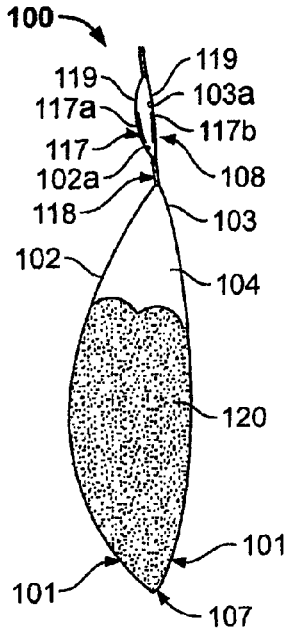
FIG. 2 is a cross-sectional view taken along line A-A of a partly opened according to FIG. 1.
Figure 3:
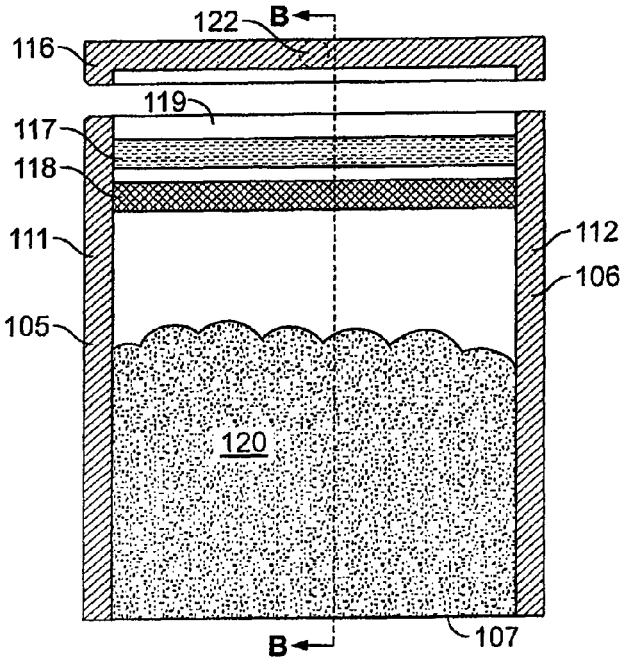
FIG. 3 is a front elevational view of a fully opened package according to FIG. 1.
Figure 4:
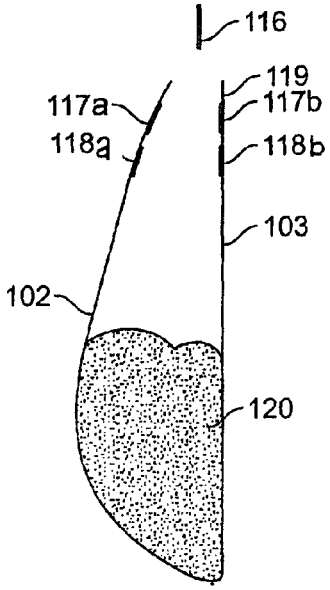
FIG. 4 a cross-sectional view taken along line B-B of the opened according to FIG. 3.

Referring to FIG. 1, a flexible package 100 is generally indicated in accordance with an embodiment of the present invention. FIG. 2 shows partly opened package 100 with reclosable seal 117 shown as opened for sake of illustration only. FIGS. 3 and 4 show package 100 with top closure portion 116 separated and removed from the remainder of the package 100.

In this illustration of FIGS. 1-4, the package 100 is formed from a flexible sheet material 101, which also is referred to herein as a film substrate, which has opposed front and rear panels 102 and 103 joined together to define a cavity 104. Food 120 or other content is contained within cavity 104. The upper end portion 108 of the package communicates with the cavity 104. For purposes of this non-limiting illustration, the flexible sheet material or film substrate 101 is a polymeric sheet. The polymeric sheet 101 has a dead-fold portion 107 formed by folding the sheet back upon itself, and the resulting overlapping opposite side portions 105 and 106 of the sheet 101 are fusion sealed together forming opposite side fusion seals 111 and 112. A fusion seal 113 also is formed at a top closure portion 116 of the package 100, providing a three-sided seal bag construction. A notched line of weakness 109 is provided immediately below and generally parallel to the top fusion seal 113, which in this illustration includes a rupturable line of weakness 114 and associated side tear notch 115. Openable reclosable closure 117 is provided below and generally parallel to fusion seal 113 and the notched line of weakness 109. A non-reclosable peelable seal 118 is provided below and generally parallel to the reclosable closure 117 at a lower location in the upper end 108 of package 100.

In this illustration, reclosable closure 117 comprises resealable adhesive bands 117*a* and 117*b* formed on the opposing inner faces 102*a* and 103*a* of walls 102 and 103 between line of weakness 114 and seal 118. Resealable adhesive bands 117*a* and 117*b* provide the user a gripping portion 119, indicated as having a dimension "X", which aids a user in manually separating the bag panels 102 and 103 apart at the resealable bands 117*a* and 117*b*. Resealable bands 117*a* and 117*b* may be applied as coatings, which, at ambient conditions, maintain sufficient integrity not to migrate, sag or flow out of position in any significant manner.

The cross-sectional view of FIG. 2 shows the resealable bands 117*a* and 117*b* pulled apart from one another prior to the first opening of the cavity 104 of package 100. The bands 117*a* and 117*b* can be provided in an unbonded or bonded configuration in the initially filled package, depending on the ease of manufacturing. The resealable bands 117*a* and 117*b* comprise a reclosable coating material suited for sealing and resealing the package 100 multiple times while exposed to ambient conditions over an extended period of time. In a particular embodiment, the reclosable coating material has low-pick tendency relative to the filled contents of the package when the food contents are dispensed from the package.

In one particular embodiment, the resealable bands 117*a* and 117*b* are comprised of a reclosable coating material, which may comprise a "cold glue" which does not delaminate from the packaging panels, retains balanced tack properties adequate to allow multiple unsealings and resealings of the package walls at the adhesive site even after the adhesive is exposed to ambient conditions over an extended period of time, and does not become contaminated and deadened (from a tackiness standpoint) from exposure to food detritus. In addition, in another embodiment, the resealable bands may be pre-applied to packaging films stored as wound spools or rolls until unwound during package manufacture, where it is desirable to provide a reclosable coating which is not overly tacky to impede unwinding operations. In a particular embodiment, the reclosable coating is cohesive in respect of being more adhesive to like band materials than substrate films or food detritus. It also may have pressure-sensitive aspects in that it forms an unsealable bond with bands of like material upon application of pressure only, i.e., without requiring the application of heat, moisture, or radiation. Resealable compositions of this general type permit the bond that they form to be readily broken, as desired, so that the package walls may be peeled apart at the location of the seal without significant damage to the substrate to which the resealable pressure-sensitive contact adhesive had been applied.

The strength of the resealable seal 117 is such that it can be readily opened by application of manual outward force to the package by the consumer, but is not susceptible to accidental opening due to normal stresses associated with product containment during storage and handling. For instance, the resealable seal 117 generally may have a peel force ranging from about 100 g/inch to about 700 g/inch, particularly about 100 g/inch to about 300 g/inch, as measured by ASTM D 3330 (peel test). The resealable seal 117 generally may have a tack value not exceeding 5 psi when pre-loaded with 4.5 pounds, and not exceeding 15 psi when pre-loaded with 10 pounds, as measured by ASTM D 2979 (probe tack). It can be resealed by application of firm manual pressure, such as by pressing the seal 117 band or bands from one lateral end towards and to the opposite lateral end thereof to help ensure a continuous seal is restored after the bag has been temporarily opened. In one non-limiting embodiment, the resealable seal 117 is substantially impermeable to air, as well as to liquids which may be present in the pouch. The level of hermeticity needed generally will be determined based on the shelf-stability and/or form and sizing of the food contents or other contents stored in the package. In other embodiments, the resealable seal 117 may comprise intermittent or discontinuous bands, or bands that only part traverse the width of the package at its mouth portion, depending in large part on the type and form of the contents intended to be stored in the package.

In one embodiment, the reclosable closure comprises substantially continuous bands 117*a* and 117*b* of reclosable coating material oppositely aligned on interior faces 102*a* and 103*a* of the front 102 and rear panels 103. The bands 117*a* and 117*b* are adapted to be manually pressed into mutual adhering contact and manually pulled apart more than once. In a particular embodiment, the reclosable coating material is a labile, coatable material which can be transformed into a flowable coating substance by processing methods involving heat application, which can be at least partly cured in place, and/or alternatively, it reverts or changes into a generally non-flowable material at room temperatures (e.g., about 80° F. or less), so that it remains affixed to a substrate at the original coating location. Also, in one non-limiting embodiment, the reclosable coating material also maintains low but sufficient bonding tack to keep the bag sealed at temperatures commonly experienced in refrigerated or frozen storage of some perishable foods, such as storage temperatures between about 32° F. to about 40° F. In one embodiment, the reclosable coating material is selected from the group consisting of ethylene vinyl acetate (EVA) copolymers, water-based acrylics, curable acrylics, and styrenic block copolymers. The reclosable coating material may be a transparent, translucent or a tinted coating material. The reclosable coating material may be sourced from commercial coatable pressure-sensitive adhesive products, such as EVA copolymer based hot melts available from Bostik Findley, Inc., or curable acrylic adhesive products. In a particular embodiment, curable acrylic adhesives are used, which in a procured state can be heated to a flowable condition and conveniently coated or deposited upon a packaging film in bands or stripes, and then are at least partly cured, e.g., via ultraviolet light irradiation or electron beam exposure, to fix the position of the coating. The acrylic can contain conventional adhesion promoters and/or photoinitiators for u.v. light irradiation, and so forth.

In another particular embodiment, the reclosable closure 117 comprises a self-supporting composite band material attached on the interior faces of the front and rear panels of the package. The composite band material may comprise a single-faced adhesive tape substrate which supports a reclosable coating, such as described above, on one side thereof which is opposite to the tacky side of the tape substrate. The tape may be a transparent, translucent or tinted discrete band material. The substrate tape material may be sourced from commercial single faced tape products, such as those available from Tesa and 3M.

In FIGS. 1-2, resealable band 117 is comprised of two resealable bands 117*a* and 117*b*. The resealable band 117 can be either one-piece or multi-piece construction, such as the illustrated two-piece construction. If a non-self-supporting bead or band of reclosable coating material is coated or otherwise deposited upon the packaging film, a single piece band is particularly convenient. However, if the resealable bands are a self-supporting composite tape type, then two discrete self-supporting pieces or bands are generally more convenient.

As indicated above, there is an additional non-reclosable peelable seal 118 provided below the resealable bands 117*a* and 117*b* that compose reclosable closure 117 that separate or isolate the resealable bands 117*a* and 117*b* from the product 120 contained in cavity 104 until peelable seal 118 is ruptured. The protective lower peelable seal 118 (i.e., 118*a*, 118*b*) is peelable to allow easy access to the product 120. The peelable seal 118 helps protect the resealable bands 117*a* and 117*b* of reclosable closure 117 from product contamination after packaging during shipment, storage, merchandising, etc., until the package is opened for the first time by the purchaser or other end user. Also, the peelable seal 118 aids in providing a hermetically-sealed package since the resealable bands 117*a* and 117*b* may extend into the side seals 111 and 112, affecting the seal quantity at those overlaps.

A hermetic peelable seal 118 is particularly desirable. A hermetic peelable seal may be formed in any suitable manner. In general, the walls 102 and 103 of packaging film 101 may be formed of a polymeric film material which is heat sealable, such that the peelable seal 118 can be formed where desired in the polymeric film per se without need for extraneous bonding materials. For example, the packaging film may be formed of a polybutylene/polyethylene blend which allows walls 102 and 103 to be heat sealed together at contacting portion that have a peel strength less than the cohesive strength of the adjoining unbonded portions of the walls. In this manner, the package 100 can be opened along peel seal 118 without tearing adjoining unbonded wall portions of the package. The strength of the peelable seal 118 is such that it can be readily opened by application of manual outward force to the package by the consumer, but is not susceptible to accidental opening due to normal stresses associated with product containment during the form/fill/seal (FFS) operation, and subsequent shipping, handling, and display. For instance, the peelable seal preferably has an opening force of from about 1.5 to about 6.0 lbs., and more preferably from about 2.5 to about 3.5 lbs. The peelable seal 118 may be formed with heat sealing techniques to provide a substantially impermeable seal to air, as well as to liquids which may be present in the pouch. Accordingly, the location of the peelable seal interiorly of the reclosable closure 117 prevents any contents of the pouch cavity 104 from leaking into the reclosable closure 117 before the filled package is purchased and initially used.

The various fusion seals 111, 112, and 113 of package 100 can be formed in conventional manners applicable to plastic bag manufacture, such as by ultrasonic sealing, heat sealing, etc. For instance, conventional heat sealing bars may be used for this purpose. The line of weakness 114 may be formed in conventional manners used to form such structural features in flexible packaging films, such as by laser scoring, using a die line, intermittent perforation, mechanical scoring, partial slitting through a packaging film laminate construction, etc. The notch 115 may be formed when the individual package is cut from a chain of bags. Alternatively, it may be formed by a conventional notched perforation wheel on the line at a perforation station or alternatively by a reciprocating perforating blade conventionally used for this purpose. The line of weakness 114 is generally horizontally aligned with a notch 115 formed at one side (or optionally both sides) of the reclosable package 100. The notch 115 is use to assist initiation of a tear and the tear line directs the tear as it propagates along the line of weakness 114, until the top edge portion 116 of the package 100 is separated from the remainder of the package 100 located below the line of weakness 114. In this manner, top fusion seal 113 represents a removable non-reclosable closure.

The film substrate 101 is a polymeric sheet material or film which may be formed of various plastic polymers, copolymers, co-extrusions and/or laminations. The polymeric sheet material or film 101 may be comprised, e.g., of monolayer or multi-layer combinations of: polyolefin such as polyethylene (high, medium, low, linear low, and/or ultra low density polymers including metallocene), polypropylene (oriented and/or biaxially oriented); polybutylene; ethylene vinyl acetate (EVA); polymides (oriented and/or biaxially oriented) such as nylon; polyethylene terephthalate (oriented and/or biaxially oriented); polyvinyl chloride; ethylene vinyl alcohol (EVOH); polyvinylidene chloride (PVDC); polyvinyl alcohol (PVOH); polystyrene; or combinations thereof.

As previously noted, in a particular embodiment the film 101 may comprise a polyethylene/polybutylene blend in which peelable seals 118 may be formed, and also non-peelable edge and/or end heat seals (e.g. 111, 112, 113). Non-peelable edge and end seals may be formed by applying greater thermal energy to the heat fusion bond sites formed in the packaging film.

The film substrate 101 also may comprise flexible polymeric film materials filled with micro- or nano-sized inorganic materials or minerals, such as clay, calcium carbonate, montmorillonite, dolmite, talc, mica, and so forth. The film subsrate 101 also may comprise flexible metallized film or a ceramic-coated film, e.g., a flexible film bearing a thin film of silicon oxide or aluminum oxide, and so forth, deposited on it. The film substrate 101 also may comprise flexible metal foil.

Film 101 desirably has air barrier properties to aid in providing hermeticity for the package, and is conducive to being heat sealed to adjoining contacted portions of folded or separate packaging film or layers. It also may incorporate non-plastic components such as foil, metallization, and/or paper, to the extent the barrier and heat sealing properties are sufficiently maintained. For purposes of example, a suitable film for cheese shreds may comprise a linear low-density polyethylene inner layer in combination with a polyester or nylon outer layer, and a middle adhesive layer of polyethylene. A nylon outer layer is particularly useful in connection with cheeses, where a degree of $CO_2$ gas permeability is desirable in the packaging.

To facilitate support of the package 100 on a display hanger, a hole 122 optionally may be provided in an upper end portion 116 of the package 100 at a location above the reclosable closure 117 and below the notched line of weakness 109. Hole 122 also could be provided below line of weakness 114 in portion 119, or below band 117.

Referring to FIGS. 5-8, a pillow-shaped releasable package 300 is illustrated in accordance with another embodiment of the invention. In this illustration, the package 300 is formed from a flexible sheet 301 of polymeric material which has opposed front and rear panels 302 and 303 joined together to define a cavity 304. In this illustration food 320 is contained within cavity 304. For example, the package 300 may be constructed by folding a polymeric sheet 301 at the opposite side portions 305 and 306 sufficient to provide flaps 335 and 336 extending in a machine direction 350 of the package 300 arranged to include a machine direction overlap portion 329 at which a fusion seal 330 is formed to provide a lengthwise fin seal, and a bottom portion 326 of package 300 is fusion sealed in a cross-machine direction 351, oriented generally perpendicular to machine direction 350, at non-peelable bottom fusion seal 307.

Figure 5:
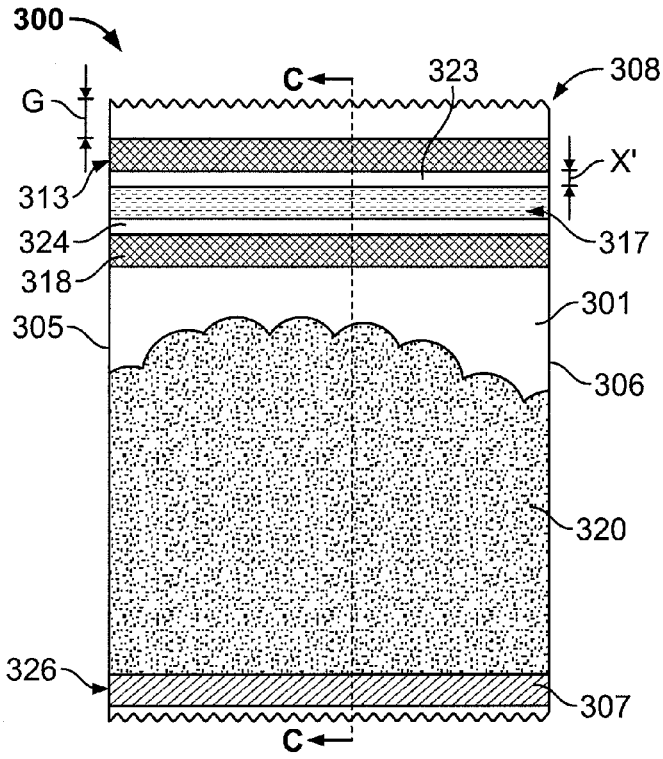
FIG. 5 is a front elevational view of a flexible reclosable package according to another embodiment of the invention.
Figure 6:
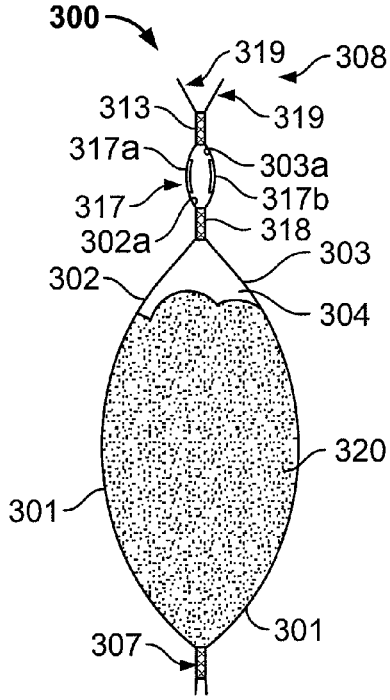
FIG. 6 is a cross-sectional view taken along line C-C of the package according to FIG. 5.
Figure 7:
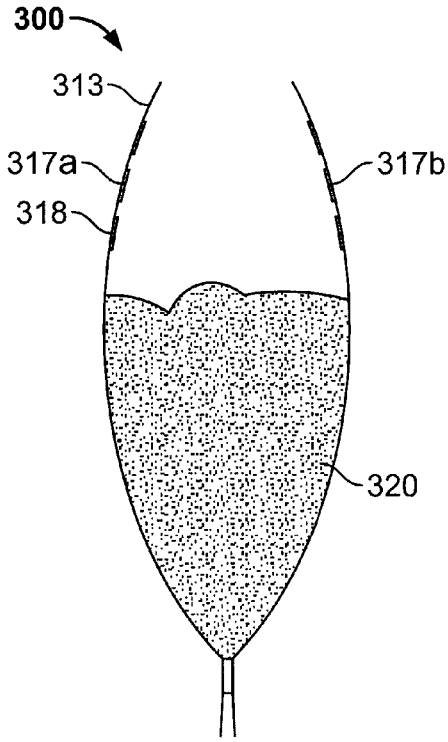
FIG. 7 a cross-sectional view taken along line C-C of an opened package according to FIG. 5.
Figure 8:
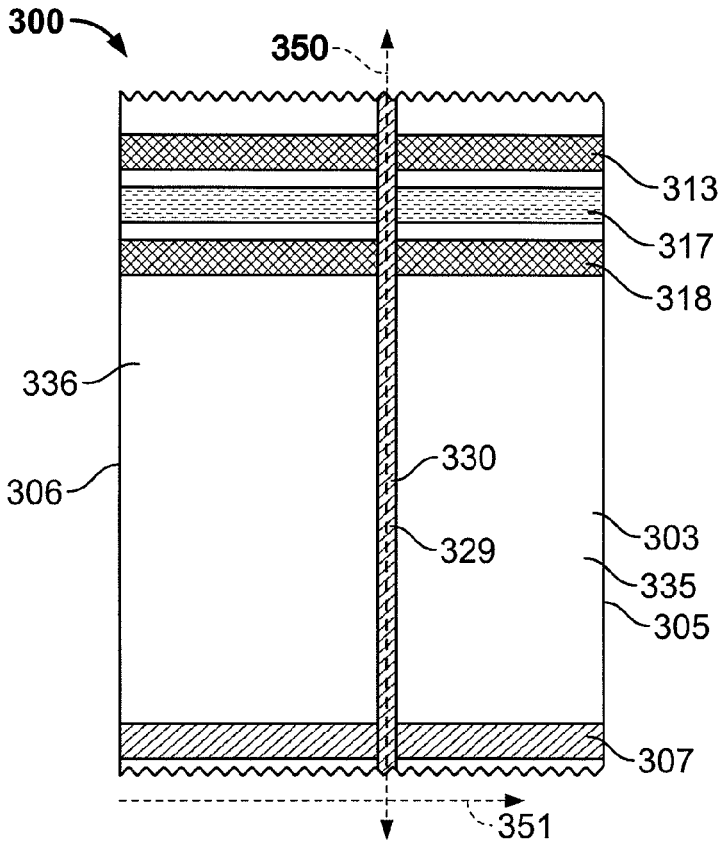
FIG. 8 is a rear elevational view of the package of FIG. 5.

At an upper end portion 308 of package 300 opposite bottom portion 326, two generally parallel, spaced-apart peelable seals 313 and 318 are provided having a construction similar to feature 118 described above. Peelable seals 313 and 318 can be provided by bonding the packaging film 301 with less thermal energy than used to form non-peelable seal 307 at the bottom of the bag 300. An openable reclosable closure 317 is provided between peelable seals 313 and 318. Reclosable closure 317 comprises resealable bands 317*a* and 317*b*. Film portion 319 extends above the upper peelable seal 313 to provide the user some loose material to grip for separating the bag panels. The dimension of film extension 319 at the top of the package is indicated by "G" (FIG. 5). There are small gap spaces 323 and 324 provided between the peelable seals 313 and 318 and the intervening reclosable closure 317, which have a dimension "X'". Similar to reclosable closure 117 described above in connection with FIGS. 1-4, the reclosable closure 317 comprises reclosable coating bands 317*a* and 317*b* formed on the opposing inner faces 302*a* and 303*a* of walls 302 and 303. The reclosable closure 317 and its constituent resealable coating bands 317*a* and 317*b* may comprise similar materials and implementations as the above-described reclosable closure feature 117. The cross-sectional view of FIG. 6 shows the resealable bands 317*a* and 317*b* as unbonded prior to the first opening of the cavity 304 of package 300. Similar also to feature 117 of FIGS. 1-4, the reclosable closure 317 can be provided as bands which are initially bonded or unbonded. Similar to feature 118 described above in connection with FIGS. 1-4, the lower peelable seal 318 provides protection to the reclosable closure 317 to avoid contamination of the food contents 320 of the package 300. FIG. 7 shows a fully opened configuration of package 300 which can be resealed at reclosable closure 317.

As illustrated in FIGS. 1-8, fill-through-the-top reclosable packages are provided with a re-openable seal for reclosing the bag upon a partial discharge of the contents thereof. These above illustrations show the relative positions of the resealable bands and non-reclosable package seals and opening features providing easy opening and reclosing of the package during use. Food materials which can be stored in these resealable packages are not particularly limited. For example, cheese shreds, ground coffee, vegetables, snack foods, confections, etc., may be contained in packages of embodiments herein. Many food products quickly deteriorate in the presence of air. Package configurations of embodiments herein also permit a consumer to easily expel air from the cavity 104 by merely applying manual pressure over the cavity region towards the package opening immediately prior to reclosing package 100 with reclosable closure 117. After any of the aforementioned bag designs 100 and 300 of FIGS. 1-8 are opened by a consumer to remove a food portion or other item stored therein, the consumer merely needs to press across the bag or pouch at a point where the resealable bands 117*a* and 117*b* (or 317*a* and 317*b*) are located to reclose and reseal the pouch for further storage of the remaining contents. Also, although the illustrations of FIGS. 1-8 describe folded single-piece package constructions, it will be appreciated that the embodiments of the present invention are also applicable to packages constructed of two-piece superposed film constructions.

Figure 9:
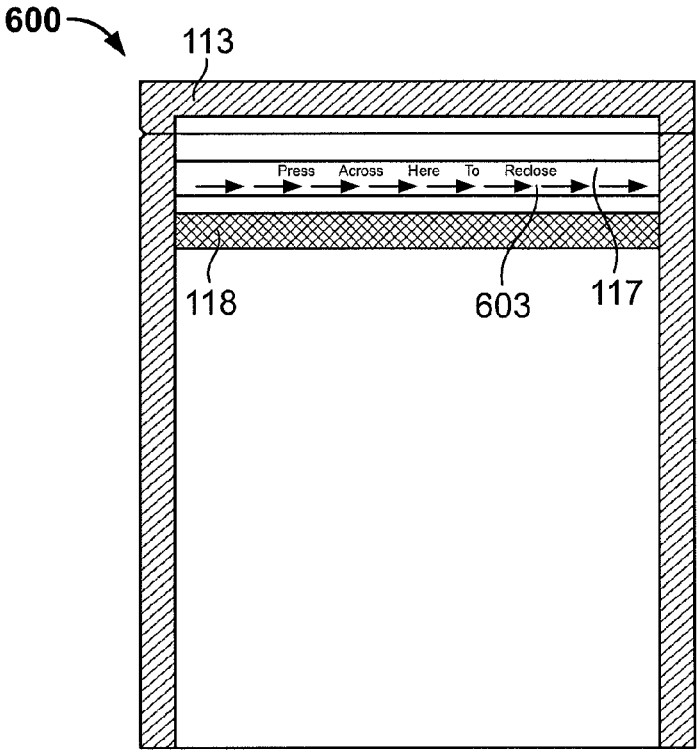
FIG. 9 is a front elevational view of a flexible reclosable package according to another embodiment of the invention.
Figure 10:
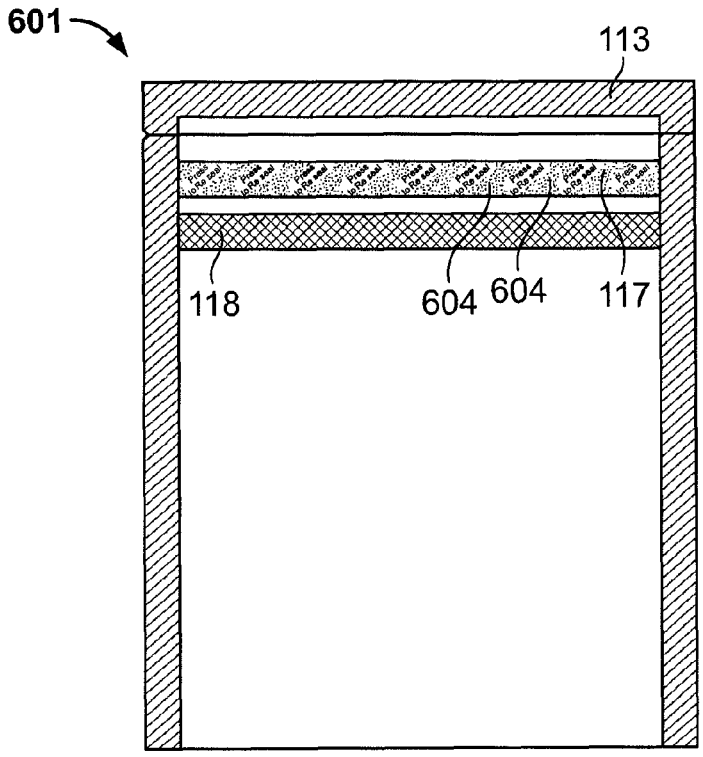
FIG. 10 is a front elevational view of a flexible reclosable package according to another embodiment of the invention.
Figure 11:
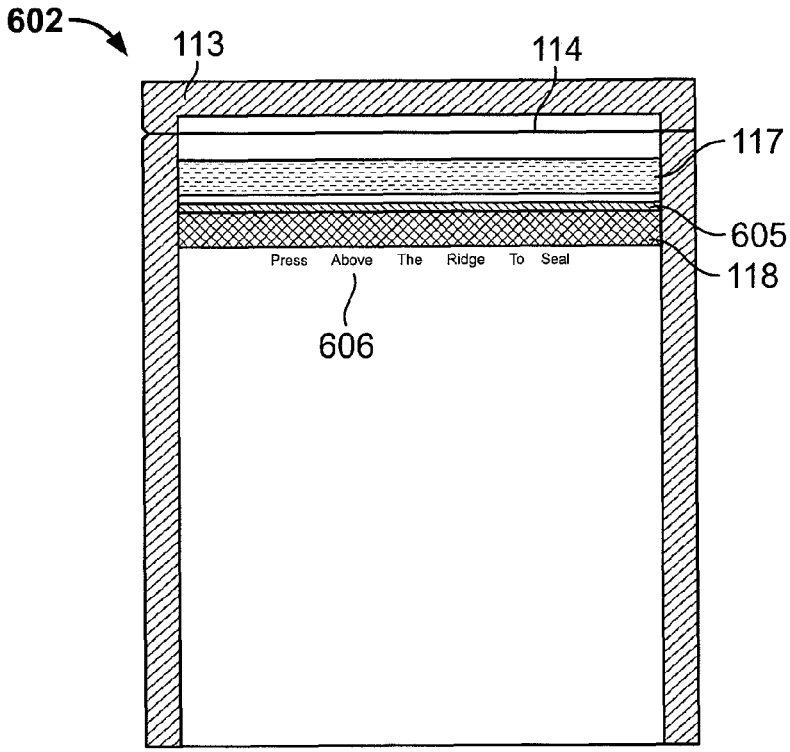
FIG. 11 is a front elevational view of a flexible reclosable package according to another embodiment of the invention.

Referring to FIGS. 9-11, in further optional embodiments, various types of indicators 603-606 may be added to a reclosable bag or pouch (600-602) to assist the consumer in locating the resealable bands 117 for efficiently locating them and using then to reclose and reseal the package. Pressing the pouches 600-602 in the proper location is imperative to effect proper resealing. The indicator provided on the package can be graphical (visual) and/or textural (tactile) in nature. Non-limiting examples of such graphical indicators 603 and 604 are shown in FIGS. 9 and 10. These graphical indicators, as illustrated, may comprise written text and/or graphical symbols. Referring to FIG. 11, a textural indicator 605 may be used, which may be, e.g., a protuberance or ridge structure formed by mechanical embossing on the packaging film 101 immediately adjacent where the reclosable closure 117 is located. Another approach may be the forming of a ridge in the film during the sealing operation. This ridge 605 also could be produced by sealing tools used to create the lower peelable seal 118. Referring still to FIG. 11, graphics 606, such as written text, also can be provided to further help instruct the user to locate and press above the ridge 605 to reseal the bag 602. Although bags 600-602 otherwise are illustrated as being similar to above-discussed reclosable flexible package 100, it will be appreciated that these further embodiments are also applicable to configurations of reclosable flexible package 300 configurations.

Figure 12:
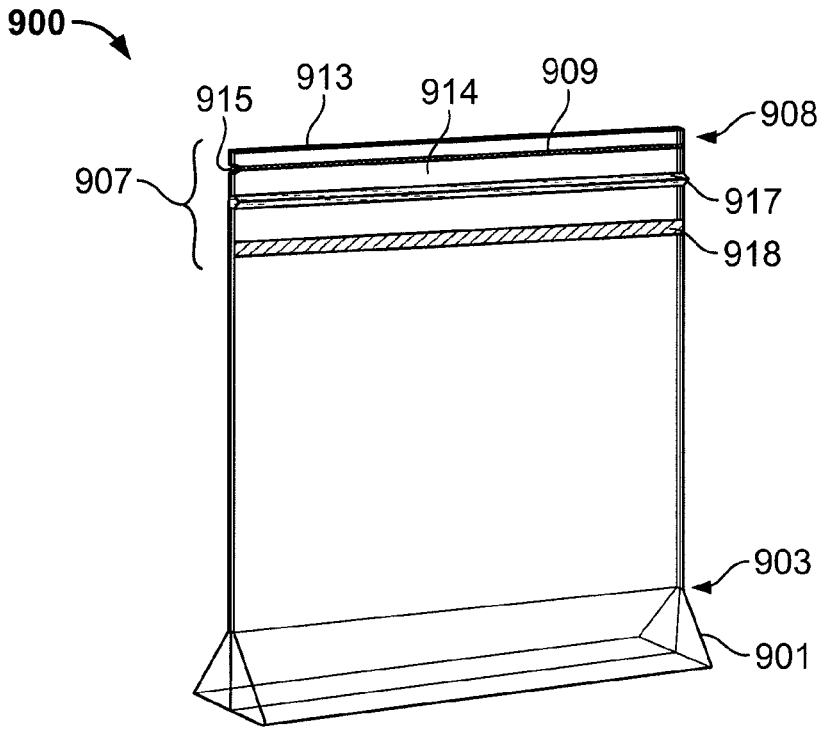
FIG. 12 is a front perspective view of a flexible reclosable stand-up package according to another embodiment of the invention.

Referring to FIG. 12, in another embodiment a flexible reclosable stand-up bag 900 is provided having a gusset portion 901 near the bottom 903 of the bag 900. At the opposite upper end 908 of the bag 900, a sealing arrangement 907 is provided that is generally similar to that of the package of FIG. 1. In this non-limiting embodiment, sealing arrangement 907 includes a notched line of weakness 909 provided immediately below and generally parallel to the top fusion seal 913, which in this illustration includes a rupturable line of weakness 914 and associated side tear notch 915. Openable reclosable closure 917 is provided below and generally parallel to fusion seal 913 and the notched line of weakness 909. A non-reclosable peelable seal 918 is provided below and generally parallel to the reclosable closure 917 at a lower location in the upper end 908 of package 900. The notched line of weakness, openable reclosable closure and non-reclosable peelable seal can have respective constructions and features as described above. The gusset portion 901 may be formed using any conventional technique used for forming such constructions in free end portions of two superposed layers of flexible plastic.

Figure 13:
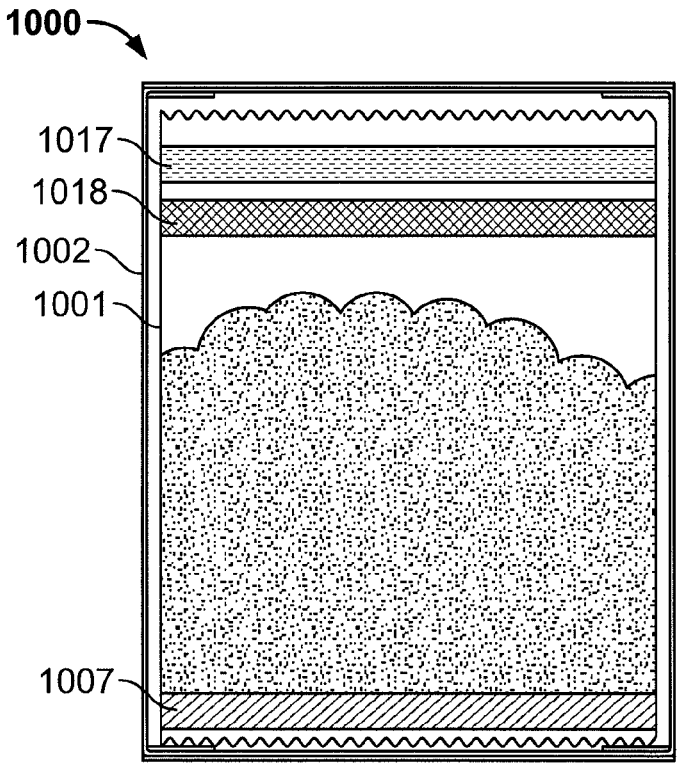
FIG. 13 is a front perspective view of a bag-in-box package according to another embodiment of the present invention.
Figure 14:
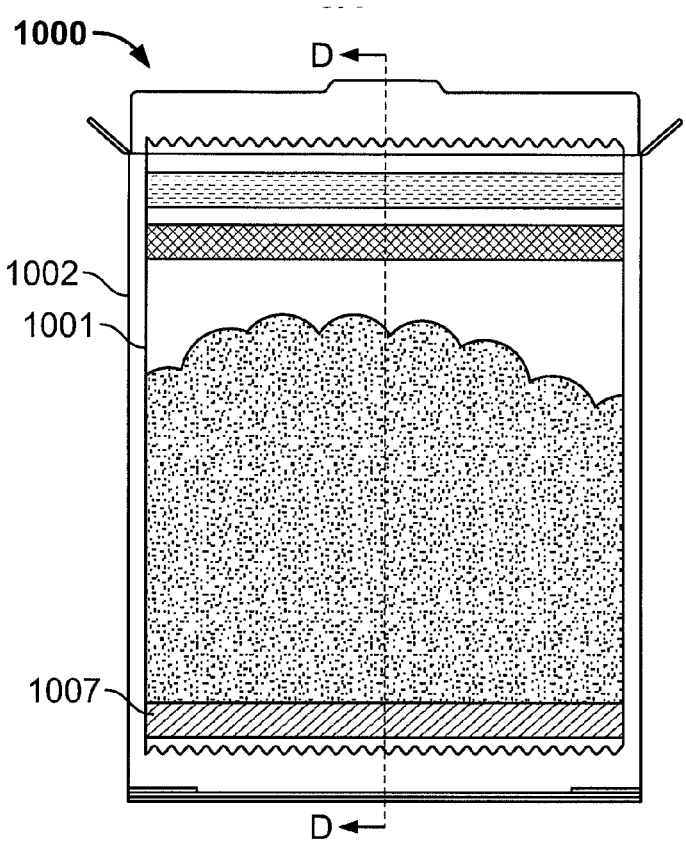
FIG. 14 is a front perspective view of the package of FIG. 13 with an opened box end.
Figure 15:
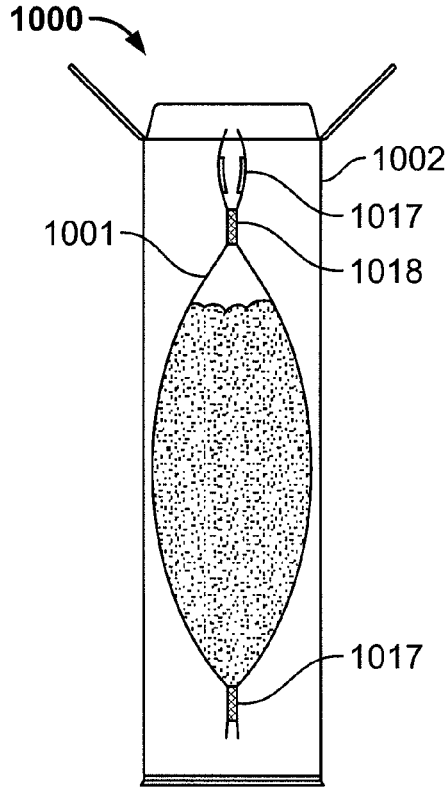
FIG. 15 a cross-sectional view taken along line D-D of a partly opened package according to FIG. 14.

Referring to FIGS. 13-15, in another embodiment a bag-in-box package 1000 is provided having a bag 1001 having a construction similar to above-described bag 300 except that a peelable seal 1018 is provided below reclosable seal 1017, but not above it. The outer, sealable packaging box 1002 effectively provides a non-reclosable seal means used in lieu of an upper non-reclosable seal formed in the pouch itself that must be initially opened before the reclosable seal 1017 can be accessed for the first time. The box packaging also lends itself to merchandising and handling. Reclosable seal 1017 is similar to above-described seal 317. A lower heat sealed portion 1007 of bag 1001 is a non-peelable seal similar to previously described seal 318.

Figure 16:
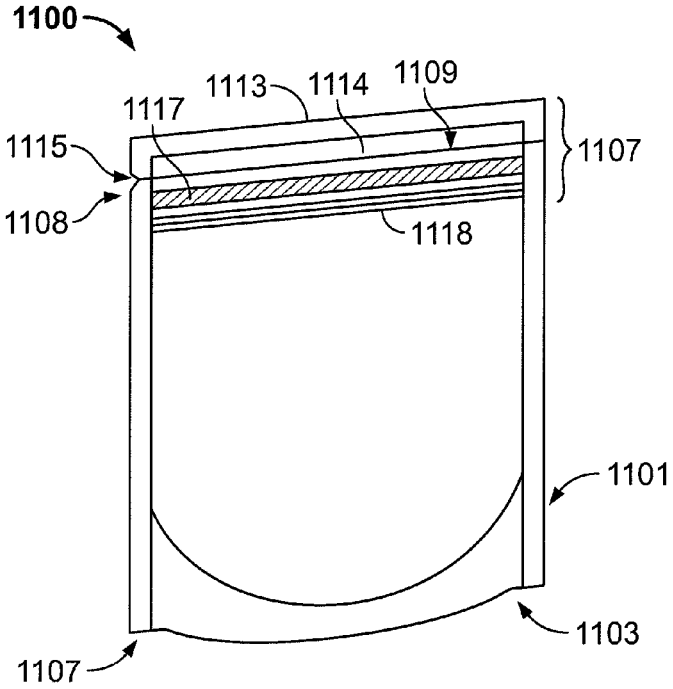
FIG. 16 is a front perspective view of a flexible reclosable Doy-style stand-up pouch according to another embodiment of the invention.
Figure 17:
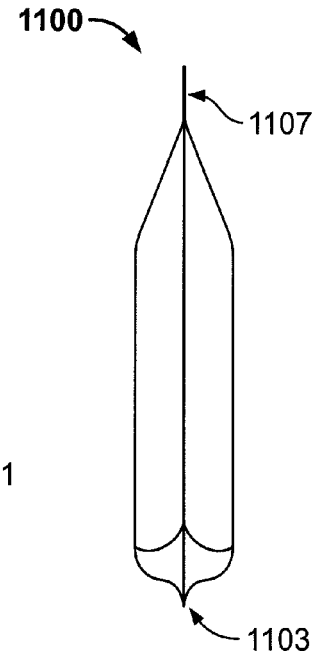
FIG. 17 is a side view of the Doy-style stand-up pouch of FIG. 16.

The reclosable package sealing arrangements of the present invention also can be applied to other styles of packages. Referring to FIGS. 16-17, for instance, in another embodiment a flexible reclosable Doy-style stand-up pouch 1100 is provided having a cupped bottom portion 1101 having a bottom seal configuration 1103 at the lower pouch end 1107 adapted to allow the pouch to stand up. At the opposite upper end 1108 of the pouch 1100, a sealing arrangement 1107 is provided that is generally similar to that of the package of FIG. 1, including a score line 1109, provided immediately below and generally parallel to the top fusion seal 1113. The score line 1109 provides a rupturable line of weakness 1114 and associated side tear notch 1115. Openable reclosable closure 1117 is provided below and generally parallel to fusion seal 1113 and the score line 1109. A non-reclosable peelable seal 1118 is provided below and generally parallel to the reclosable closure 1117 at a lower location in the upper end 1108 of package 1100.

Figure 18:
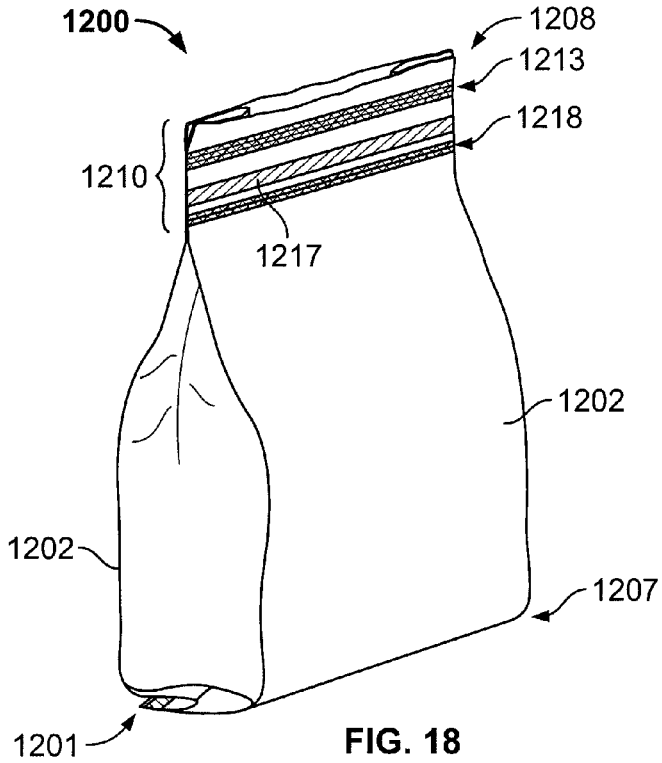
FIG. 18 is a perspective view of a flexible reclosable stand-up package with tucked bottom seal according to another embodiment of the invention.

Referring to FIG. 18, in yet another embodiment a flexible flat bottom bag 1200 with a tucked bottom seal portion 1201 is provided. This embodiment is a variation of the pillow-shaped reclosable package such as illustrated in FIGS. 5-8. In this illustration, the flat bottom bag 1200 is formed from a flexible sheet of polymeric material 1202 defining a cavity. The bag 1200 has and upper end 1208 and lower end 1207. The sealing arrangement 1210 provided at the upper end 1208 is similar to that described above for the package 300 illustrated in FIGS. 5-8, and includes a resealable coating 1217, which can be similar to above-described reclosable closure 317, provided between upper and lower peelable seals 1213 and 1218, which may similar to above-described peelable seals 313 and 318. At the opposite lower end 1207 of the bag 1200, loose ends of the polymeric sheet material 1202 are joined as a tucked bottom seal to provide a flat bottom structure.

In non-limiting form, fill and seal ("FFS") operations applicable to manufacturing resealable packages according to the illustration of FIG. 1, the package 100 is manufactured with a horizontal or vertical fill technique. In one exemplary horizontal FFS operation, a bag chain, precoated with transverse bands of reclosable coating 117 intermittently along its length, has side fusion seals 111 and 112 formed in a given folded pouch. The intermediate bag with sealed sides is cut from the bag chain, then filled with product at its open end, and the filled pouch cavity is gas flushed (e.g. $N_2$ or $CO_2$). Peelable seal 118 is formed in the upper open mouth portion of the bag, followed by formation of non-peelable top edge seal 113 to seal the contents within the pouch. Reclosable coating 117 and peelable seal 118 can be formed in manners such as previously described herein. Fusion seal 113, for example, is formed at the horizontal top edge of the package, such as by using a conventional horizontally-oriented sealing bar, along with the notched line of weakness 109, to provide a hermetically-sealed, resealable filled package. The process provides an impermeable marginal sealed area on each side of the filled pouch. Where a punched hole 122 is desired, a punch apparatus may be provided at a convenient location on the production line.

In an alternative FFS operation for making packages such as illustrated in FIG. 5, a right-side up or an inverted vertical fill operation may be used to form filled package 300. In a right-side up vertical fill procedure, a bag chain is provided with reclosable coating 317 at intermittent transverse locations. A bottom seal 307 is initially formed for a given bag. The intermediate bag is then filled and flushed. Then, peelable seal 318 and non-peelable seal 313 are formed, in that sequence, and the sealed filled bag is cut from the bag chain. In an inverted bag FFS operation, filled package 300 can be assembled generally by reversing the sequence of steps, such that the mouth-end seals 313, 317 and 318 are formed first, following by filling the bag, and finally by forming bottom seal 307.

The resealable flexible packages of embodiments of the invention offer many advantages over traditional package resealing arrangements, and particularly zippers. Manufacturing of the flexible packages of the preferred embodiments is streamlined because resealable bands used to form the reclosable closure (e.g., above-described features 117 and 317) are easier and less costly to apply and use than an integral zipper. Also, a conventional film converter may be used to coat the bands directly onto the film where needed and deliver all the materials on a ready-to-use single roll. In that case no additional equipment is necessary to make the packages of embodiments herein. This enables the manufacture of reclosable packages according to embodiments herein on a variety of form, fill, and seal machines. Since the reseal bands used to form the reclosable closure are applicable as a thin coating, the resulting low material usage provides a cost savings relative to zipper packaging, especially higher cost slider zipper packaging. Consumers have added ease and comfort using the packaging of embodiments herein due to the easy and reliable closing of the reseal band arrangement used in packages of embodiments herein versus the often difficult and inconsistent press-to-close zippers. Also, tamper-resistance is provided for the reclosable closure and package contents by provision of hermetic manually-openable, non-reclosable seals at both sides of the reclosable closure, which serve to better isolate it during manufacture, shipping, storage, handling and display, etc., until purchased and used by a consumer.

Methods of forming and using the reclosable package are also provided. Namely, if the heat seal (113, 313) is ruptured in a displayed package, it alerts that possible access or exposure of the reclosable coating seal (117, 317) has occurred prior to purchase. If the peelable seal (118, 318) is ruptured, it alerts that the package contents may have been exposed prior to purchase. The resealable seal and food contents thus can be better preserved in as-packaged conditions until sold and used.

What is claimed is:

1. A reclosable flexible package, comprising:

opposed front and rear panels joined together to define a cavity enclosed by opposite side portions and a bottom portion of the package, each of the front and rear panels having an interior face and formed from a film substrate including nano-sized particles of montmorillonite;

an openable/removable non-reclosable closure provided on the interior faces of both the front and rear panels, located at an upper end portion of the package opposite the bottom portion and extending between opposite side portions of the package, adapted to define a package mouth when opened or removed;

an openable reclosable closure comprising a reclosable coating, provided from a cured acrylic adhesive, disposed on the interior faces of both the front and rear panels having the nano-sized particles of montmorillonite therein, extending between the opposite side portions of the package at a location below the openable/removable non-reclosable closure, the openable reclosable closure having a peel force of about 100 g/inch to about 700 g/inch and a tack value up to about 5 psi when pre-loaded with 4.5 pounds and up to about 15 psi when preloaded with 10 pounds so that the openable reclosable closure is adapted to be manually pulled open and reclosed for selectively opening and closing said mouth after said openable/removable non-reclosable closure has been opened or removed, the reclosable closure includes substantially continuous bands of reclosable coating oppositely aligned on the interior faces of the front and rear panels, wherein the peel force and tack value are effective so that the bands can be pressed into mutual adhering contact and manually pulled apart more than once, and the reclosable coating is effective so that it is not deadened from exposure to detritus such that the peel force remains between about 100 g/inch to about 700 g/inch after contamination with detritus;

an openable non-reclosable heat seal between contacting portions of the front and rear panels extending between the opposite side portions of the package at a location below the reclosable closure; and a bond of the cured acrylic adhesive to the film substrate including nano-sized particles of montmorillonite such that the cured acrylic adhesive does not delaminate therefrom upon first opening of the package even though the cured acrylic adhesive has a stronger bond strength to itself than to the film substrate.

2. The package of claim 1, wherein the reclosable coating has a surface energy substantially the same as a surface energy of the interior face of the film substrate.

3. The package of claim 1, wherein the reclosable closure comprises a discrete self-supporting composite tape material attached on interior faces of the front and rear panels, wherein the self-supporting composite tape material comprises the reclosable coating on one side thereof.

4. The package of claim 1, further including textual indicia instructing package users where to apply pressure at the reclosable closure for facilitating reclosing of the package.

5. The package of claim 1, further including textural indicia comprising a protuberance and textual indicia instructing package users where to apply pressure at the reclosable closure for facilitating reclosing of the package.

6. The package of claim 1, wherein the openable/removable non-reclosable closure extends between the opposite side portions of the package forming an air seal between the exterior of the package and the reclosable closure.

7. The package of claim 1, further comprising a rupturable line of weakness between the openable/removable non-reclosable closure and the reclosable closure, adapted, upon complete rupture, to allow removal of the openable/removable non-reclosable closure.

8. The package of claim 7, wherein the line of weakness intersects a notch provided on at least one side edge of the package.

9. The package of claim 1, wherein the package comprises a construction wherein a folded polymeric sheet provides the front and rear wall panels which are joined at opposite side portions thereof and folded at a bottom portion thereof.

10. The package of claim 1, wherein package comprises a construction wherein a polymeric plastic sheet is folded at the opposite side portions sufficient to provide a machine direction overlap portion which is sealed and a bottom portion is sealed in a cross-machine direction.

11. The package of claim 1, further comprising food stored in the package cavity.

12. The reclosable flexible package of claim 1, wherein the bond of the cured acrylic adhesive to the film substrate including the nano-sized particles of montmorillonite is such that the cured acrylic adhesive does not delaminate therefrom upon first opening of the package even though the cured acrylic adhesive has a stronger bond to itself than to polymers of the film substrate.

13. A reclosable package comprising a box including a peelable flap closure at one end thereof and containing a flexible bag adapted to be filled at least in part with food, wherein the flexible bag has front and rear panels, each of which have an interior face and formed from a film substrate including nano-sized particles of montmorillonite, and includes a reclosable closure provided from a cured acrylic adhesive on the interior faces of the front and rear panels having the nano-sized particles of montmorillonite therein in combination with a non-reclosable closure on the interior faces of the front and rear panels and located below the reclosable closure in the flexible bag, the reclosable closure having a peel force of about 100 g/inch to about 700 g/inch and a tack value up to about 5 psi when pre-loaded with 4.5 pounds and up to about 15 psi when preloaded with 10 pounds so that the reclosable closure is adapted to be manually pulled open and reclosed for selectively opening and closing a mouth of the flexible bag, the reclosable closure includes substantially continuous bands of reclosable coating oppositely aligned on the interior faces of the front and rear panels, wherein the peel force and tack value enable the bands to be pressed into mutual adhering contact and manually pulled apart more than once, and the reclosable coating is effective so that it is not deadened from exposure to detritus such that the peel force remains between about 100 g/inch to about 700 g/inch after contamination with detritus, and the reclosable coating has a surface energy substantially the same as a surface energy of the interior face of the film substrate; and a bond of the cured acrylic adhesive to the film substrate including the nano-sized particles of montmorillonite such that the cured acrylic adhesive does not delaminate therefrom upon first opening of the package even though the cured acrylic adhesive has a stronger bond to itself than to the film substrate.

14. The reclosable package of claim 13, wherein the bond of the cured acrylic adhesive to the film substrate including the nano-sized particles of montmorillonite is such that the cured acrylic adhesive does not delaminate therefrom upon first opening of the package even though the cured acrylic adhesive has a stronger bond to itself than to polymers of the film substrate.

15. A method of forming a reclosable flexible package, comprising:

joining opposed front and rear panels together to define a cavity enclosed by opposite side portions and a bottom portion of the package, and an open upper end communicating with the cavity, each of the front and rear panels have an interior face and formed from a film substrate including nano-sized particles of montmorillonite therein;

forming, in the open upper end, an openable non-reclosable closure between the interior faces of the front and rear panels and extending between the opposite side portions of the package;

forming, at a location above the openable non-reclosable closure in the open upper end, an openable reclosable closure by applying substantially continuous bands of a reclosable coating provided from a flowable curable acrylic adhesive in aligned opposition on interior faces of the front and rear panels having the inorganic filler therein, wherein the openable reclosable closure extends between the interior faces of the front and rear panels and between the opposite side portions of the package, the openable reclosable closure having a peel force of about 100 g/inch to about 700 g/inch and a tack value up to about 5 psi when pre-loaded with 4.5 pounds and up to about 15 psi when preloaded with 10 pounds so that the openable reclosable closure is adapted to be manually pulled open and reclosed for selectively opening and closing the upper end, wherein the peel force and tack valve are effective so that the bands are adapted to be pressed into mutual adhering contact and manually pulled apart more than once, wherein the reclosable coating has a surface energy substantially the same as a surface energy of the interior face of the film substrate;

forming an openable/removable non-reclosable heat seal, located above the openable reclosable closure in the upper end and extending between the interior faces of the front and rear panels and between opposite side portions of the package, adapted to define a package mouth in the upper end when opened or removed; and a bond of the cured acrylic adhesive to the film substrate including the nano-sized particles of montmorillonite such that the cured acrylic adhesive does not delaminate therefrom upon first opening of the package even though the cured acrylic adhesive has a stronger bond to itself than to the film substrate.

16. The method of claim 15, wherein forming the reclosable closure comprises attaching discrete self-supporting composite tape material on interior faces of the front and rear panels, wherein the self-supporting composite tape material comprises the reclosable coating on one side thereof.

17. The method of claim 15, further comprising introducing food into the package before completing all said forming and joining steps.

18. The method of claim 15, wherein the reclosable coating is effective so that it is not deadened from exposure to detritus such that the peel force remains between about 100 g/inch to about 700 g/inch after contamination with detritus.

19. The method of claim 15, wherein the bond of the cured acrylic adhesive to the film substrate including the nano-sized particles of montmorillonite is such that the cured acrylic adhesive does not delaminate therefrom upon first opening of the package even though the cured acrylic adhesive has a stronger bond to itself than to polymers of the film substrate.

* * * * *